US007052342B2

(12) United States Patent
Tanaka et al.

(10) Patent No.: US 7,052,342 B2
(45) Date of Patent: May 30, 2006

(54) PERSONAL WATERCRAFT

(75) Inventors: Yoshinobu Tanaka, Kako-gun (JP); Hironori Tomari, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/817,062

(22) Filed: Apr. 2, 2004

(65) Prior Publication Data

US 2004/0242092 A1 Dec. 2, 2004

(30) Foreign Application Priority Data

Apr. 4, 2003 (JP) ..... 2003-101690

(51) Int. Cl.
*F02B 61/04* (2006.01)

(52) U.S. Cl. ..... 440/88 A

(58) Field of Classification Search ..... 440/88 A, 440/38, 83

See application file for complete search history.

(56) References Cited

U.S. PATENT DOCUMENTS

| | | | | |
|---|---|---|---|---|
| 5,735,229 | A * | 4/1998 | House et al. | 114/363 |
| 6,471,557 | B1 * | 10/2002 | Hattori | 440/88 R |
| 6,544,084 | B1 | 4/2003 | Nanami | |
| 2003/0129888 | A1 * | 7/2003 | Nakajima et al. | 440/88 A |

* cited by examiner

*Primary Examiner*—Ed Swinehart
(74) *Attorney, Agent, or Firm*—Allenman Hall McCoy Russell & Tuttle LLP

(57) ABSTRACT

A water-jet propulsion personal watercraft comprises a body including a hull and a deck covering the deck from above, a water jet pump disposed on a rear portion of the body and configured to propel the watercraft, an engine mounted forward relative to the water jet pump within the body and configured to drive the water jet pump, a propeller shaft configured to connect the engine to the water jet pump, a coupling mechanism disposed behind the engine and configured to connect an output shaft of the engine to the propeller shaft, and an air cleaner box disposed behind the engine and above the coupling mechanism within the body and configured to take in air for the engine from outside.

8 Claims, 5 Drawing Sheets

PERSONAL WATERCRAFT

BACKGROUND OF THE INVENTION

1. Field of the Invention

The present invention relates to a water-jet propulsion personal watercraft and, more particularly, to an air cleaner box of an engine mounted in a body of the watercraft.

2. Description of the Related Art

In recent years, water-jet propulsion personal watercraft have been widely used in leisure, sport, rescue activities, and the like. The personal watercraft is equipped with an engine mounted within a body surrounded by a hull and a deck covering the hull from above. An air-cleaner box is provided in an internal space of the body and configured to take in air from outside. The air taken into the air cleaner box flows through a throttle body, an air-intake pipe, an air-intake manifold, and the like, and then is delivered to a combustion chamber of the engine.

A water jet pump is provided behind the engine and configured to propel the watercraft. An output shaft of the engine is connected to a pump shaft of the water jet pump through a coupling mechanism provided behind the engine and in the vicinity of an inner bottom portion of the body. Therefore, upon engine operation, the pump shaft rotates integrally with the output shaft. Driven by the engine, the water jet pump pressurizes and accelerates water sucked from a water intake generally provided on a bottom surface of the hull and ejects it rearward from an outlet portion of the water jet pump. As the resulting reaction, the watercraft gains a propulsion force.

In the personal watercraft, water sometimes enters the internal space of the body. And, the water in the internal space of the body may be suctioned into the air cleaner box together with the air within the body.

The water flowing into the air cleaner box together with air might be delivered to the combustion chamber of the engine. In order to avoid this, the air cleaner box is provided at a location above the engine where water is less likely to enter the air cleaner box or forward relative to the engine so as to be distant from the coupling mechanism that would scatter water (see Japanese Laid-Open Patent Application Publication No. 2000-335486).

In the straddle-type personal watercraft equipped with a seat mounted over the deck and straddled by an operator, a deck opening is formed on an upper portion of the deck and below the seat to allow inside and outside of the body to communicate with each other. And, the engine and the air cleaner box are maintained through the deck opening.

In recent years, a four-cycle engine has been put into practical use in place of the conventional two-cycle engine, as the engine mounted in the personal watercraft. The four-cycle engine is constructed such that valve drive system components of the engine such as air-intake and exhaust valves, a camshaft, and the like are provided in the cylinder head located above a cylinder. So, the four-cycle engine has a height larger than that of the two-cycle engine. When the four-cycle engine is mounted in the limited internal space of the body of the watercraft, it is difficult to dispose an air cleaner box above the engine.

The deck opening through which the engine and the air cleaner box are maintained has a limited opening area for keeping rigidity of the body. This leads to limited placement of the air cleaner box. For example, when the air cleaner box is disposed forward relative to the engine, maintenance of the air cleaner box becomes burdensome, because the air cleaner box is relatively distant from the deck opening.

SUMMARY OF THE INVENTION

The present invention addresses the above described condition, and an object of the present invention is to provide a water-jet propulsion personal watercraft capable of inhibiting water entering an engine room from the outside of the watercraft from flowing into an air cleaner box and of easily maintaining the air cleaner box.

According to the present invention, there is provided a water-jet propulsion personal watercraft comprising a body including a hull and a deck covering the deck from above; a water jet pump disposed on a rear portion of the body and configured to propel the watercraft; an engine mounted forward relative to the water jet pump within the body and configured to drive the water jet pump; a propeller shaft configured to connect the engine to the water jet pump, a coupling mechanism disposed behind the engine and configured to connect an output shaft of the engine to the propeller shaft; and an air cleaner box disposed behind the engine and above the coupling mechanism within the body and configured to take in air for the engine from outside the watercraft.

In the above construction, since the space behind the engine is efficiently used, and the air cleaner box is disposed behind the engine and above the coupling mechanism, water scattered by the coupling mechanism collides against a bottom face of the air cleaner box and is inhibited from being scattered farther. Thus, water ingress into the air cleaner box can be inhibited. In addition, the air cleaner box can be easily maintained.

The engine may be a four-cycle engine. The above construction is suitable to the four-cycle engine having a relatively large height which makes it difficult for the air cleaner box to be disposed above the engine.

The air cleaner box may be supported by the body and may be connected to an air-intake pipe of the engine through a flexible connecting pipe. In such a structure, by removing the flexible connecting pipe, the air cleaner box can be easily separated from the engine. Thus, the air cleaner box can be easily attached and removed, and hence is easy to maintain. In addition, since the air cleaner box is supported by the body, vibration of the engine is not transmitted to the air cleaner box. So, wear of the air cleaner box can be inhibited. For the flexible connecting pipe, tubular rubber boot, or a bellows-like tubular member made of synthetic resin may be used.

The jet-propulsion personal watercraft may further comprise a storage box removably mounted behind and adjacent the air cleaner box, the storage box being mounted into the body from above. In such a structure, by removing the storage box from the body, the interior of the body is accessible through an opening for the storage box, at which the storage box is attached to the body. Therefore, the air cleaner box is easily accessible and is easier to maintain.

The water-jet propulsion personal watercraft may further comprise a first opening provided at a position of the deck above the engine; a second opening provided to be spaced apart from and behind the first opening, wherein the storage box is removably fitted to the second opening, and the air cleaner box is supported by an upper wall of the deck between the first and second openings and connected to an air-intake pipe of the engine through a flexible connecting pipe.

The air cleaner box may have an air inlet, and a cover may be configured to cover the air inlet such that a gap is formed between the air inlet and the cover. Such a structure can inhibit the water entering the interior of the body from flowing into the air cleaner box. When the interior of the personal watercraft is cleaned with water, water ingress into the air cleaner box can be inhibited.

The air inlet of the air cleaner box may be provided on an upper portion of the air cleaner box, and the air cleaner box may be provided with an air guide pipe having the air inlet and an outlet and extending downward from the air inlet to a lower portion of the air cleaner box within the air cleaner box. In such a structure, when the watercraft is inverted, an opening end of the air guide pipe which is located inside of the air cleaner box, is located higher than the air inlet. Therefore, it is possible to inhibit water ingress into the air cleaner box when the watercraft is inverted. Further, the air cleaner box can generate a buoyant force for the inverted watercraft.

The air inlet may be provided in a concave portion formed on an upper portion of a front wall of the air cleaner box.

The air cleaner box may have a separating wall provided inside thereof and configured to divide an internal space into a plurality of sub-spaces, and a communicating passage may be provided on the separating wall to allow the sub-spaces to fluidically communicate with each other. Since air flows within the sub-spaces through the communicating passage, air-intake noise can be reduced. When the watercraft is inverted, the separating wall can inhibit water entry into the sub-spaces, and the air cleaner box can generate a buoyant force for the inverted watercraft.

The above and further objects and features of the invention will more fully be apparent from the following detailed description with the accompanying drawings.

DETAILED DESCRIPTION OF THE PREFERRED EMBODIMENTS

Figure 1:
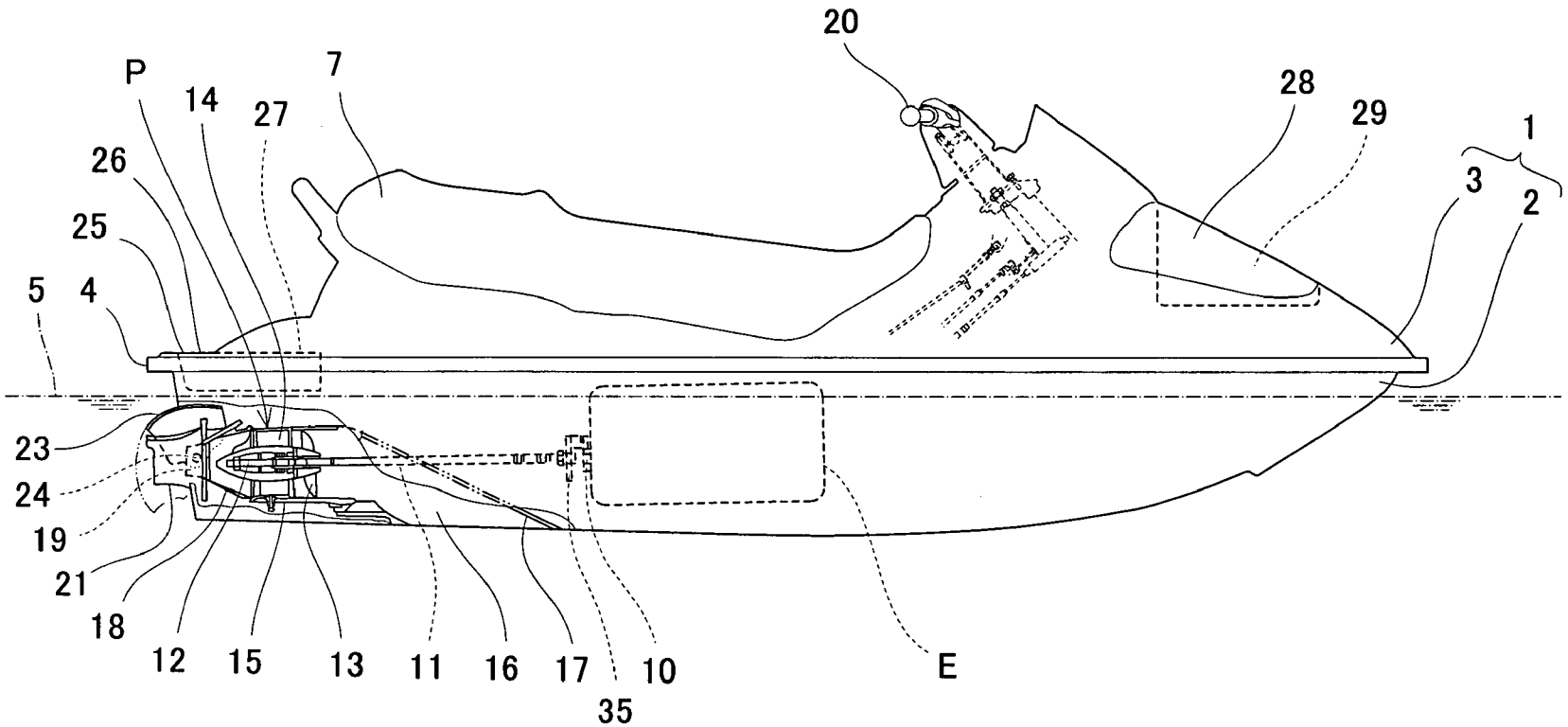
FIG. 1 is a side view of a personal watercraft according to an embodiment of the present invention.

Hereinafter, a personal watercraft according to an embodiment of the present invention will be described with reference to the accompanying drawings. A personal watercraft in FIG. 1 is straddle-type personal watercraft equipped with a seat 7 straddled by an operator. A body 1 comprises a hull 2 and a deck 3 covering the hull 2 from above. A line at which the hull 2 and the deck 3 are connected over the entire perimeter thereof is called a gunnel line 4. In FIG. 1, reference numeral 5 denotes a waterline under the condition in which the personal watercraft is at rest on water.

Figure 2:
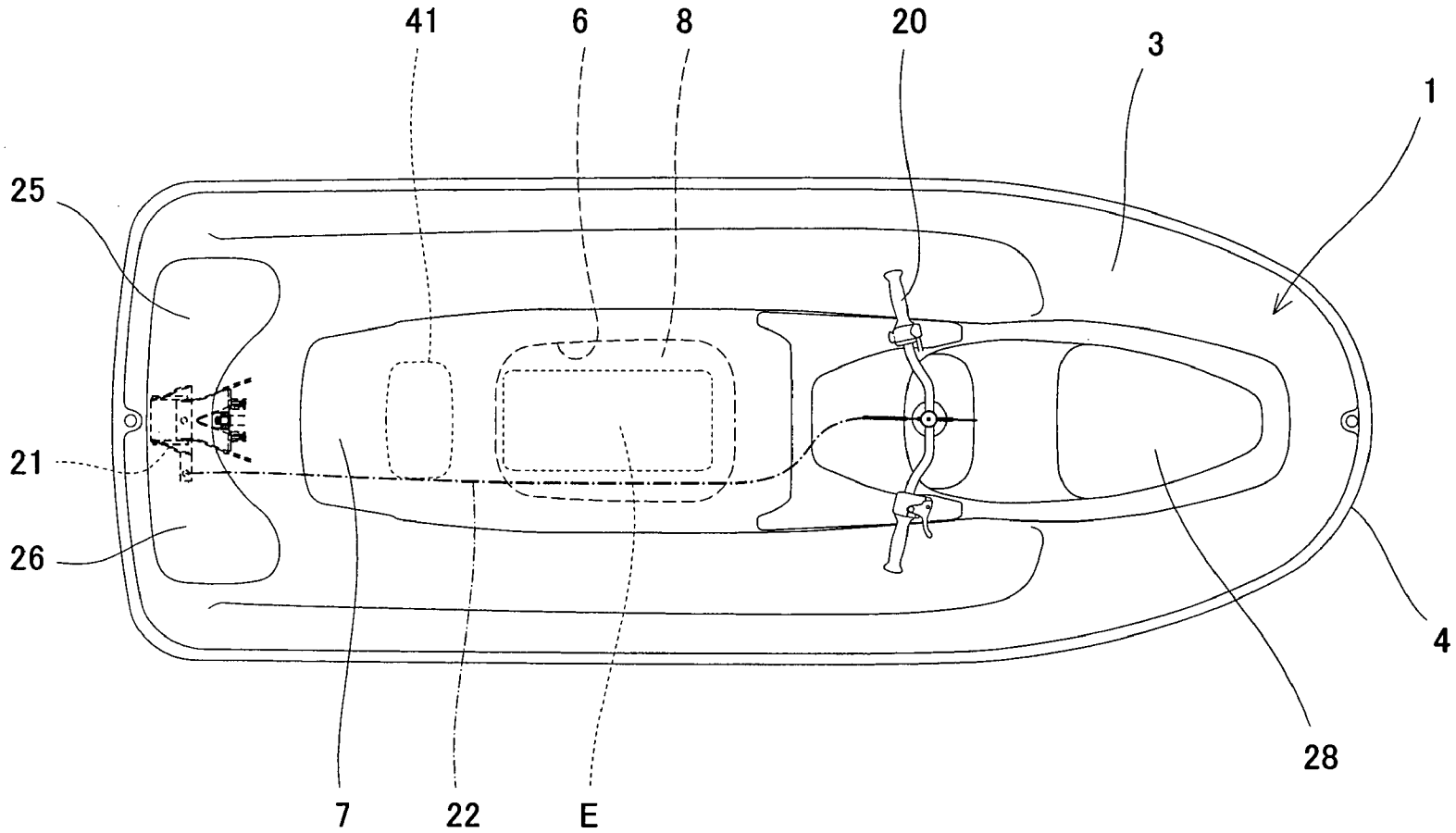
FIG. 2 is a plan view of the personal watercraft in FIG. 1.

As shown in FIG. 2, a first deck opening 6 substantially rectangular in a plan view is formed at a substantially center section of the deck 3 on an upper portion of the body 1 such that its longitudinal direction corresponds with the longitudinal direction of the body 1. Through the first deck opening 6, the engine E and auxiliary devices are mounted into the body 1. The seat 7 is removably mounted over the first deck opening 6.

An engine room 8 is provided in a space defined by the hull 2 and the deck 3 below the first deck opening 6. An engine E is mounted within the engine room 8 and configured to drive a water jet pump P that propels the watercraft. The engine room 8 has a convex-shaped transverse cross-section and is configured such that its upper portion is smaller than its lower portion. In this embodiment, the engine E is an in-line four-cylinder four-cycle engine.

As shown in FIG. 1, the engine E is mounted such that a crankshaft (output shaft) 10 extends along the longitudinal direction of the body 1. A rear end of the crankshaft 10 is rotatably coupled integrally with a pump shaft 12 of the water jet pump P provided on the rear side of the body 1 through a coupling mechanism 35 and a propeller shaft 11.

An impeller 13 is attached on the pump shaft 12 of the water jet pump P. Fairing vanes 14 are provided behind the impeller 13. The impeller 13 is covered with a pump casing 15 on the outer periphery thereof.

A water intake 16 is provided on the bottom of the body 1. The water intake 16 is connected to the pump casing 15 through a water passage 17. The pump casing 15 is connected to a pump nozzle 18 provided on a rear portion of the body 1. The pump nozzle 18 has a cross-sectional area that gradually reduces rearward, and an outlet port 19 is provided on the rear end of the pump nozzle 18.

The water outside the watercraft is sucked from the water intake 16 and fed to the water jet pump P. The water jet pump P pressurizes and accelerates the water and the fairing vanes 14 guide water flow behind the impeller 14. The water is ejected through the pump nozzle 18 and from the outlet port 19 and, as the resulting reaction, the watercraft obtains a propulsion force.

A bar-type steering handle 20 is provided in front of the seat 7. The handle 20 is connected to a steering nozzle 21 provided behind the pump nozzle 18 through a cable 22 in FIG. 2. When the rider rotates the handle 20 clockwise or counterclockwise, the steering nozzle 21 is swung toward the opposite direction so that the ejection direction of the water being ejected through the pump nozzle 18 can be changed, and the watercraft can be correspondingly turned to any desired direction while the water jet pump P is generating the propulsion force.

As shown in FIG. 1, a bowl-shaped reverse deflector 23 is provided on the rear side of the body 1 and on an upper portion of the steering nozzle 21 such that it can vertically swing around a horizontally mounted swinging shaft 24 extending in a width direction of the watercraft. When the deflector 23 is swung downward to a lower position around the swinging shaft 24 so as to be located behind the steering nozzle 21, the water being ejected rearward from the steering nozzle 21 is ejected substantially forward. As the resulting reaction, the personal watercraft moves rearward.

As shown in FIGS. 1 and 2, a rear deck 25 is provided on the rear side of the body 1. The rear deck 25 is provided with an openable rear hatch cover 26. A storage box 27 with a small capacity is provided under the rear hatch cover 26. And, a front hatch cover 28 is provided on a front portion of the body 1. A storage box 29 having a predetermined capacity is provided below the hatch cover 28.

Figure 3:
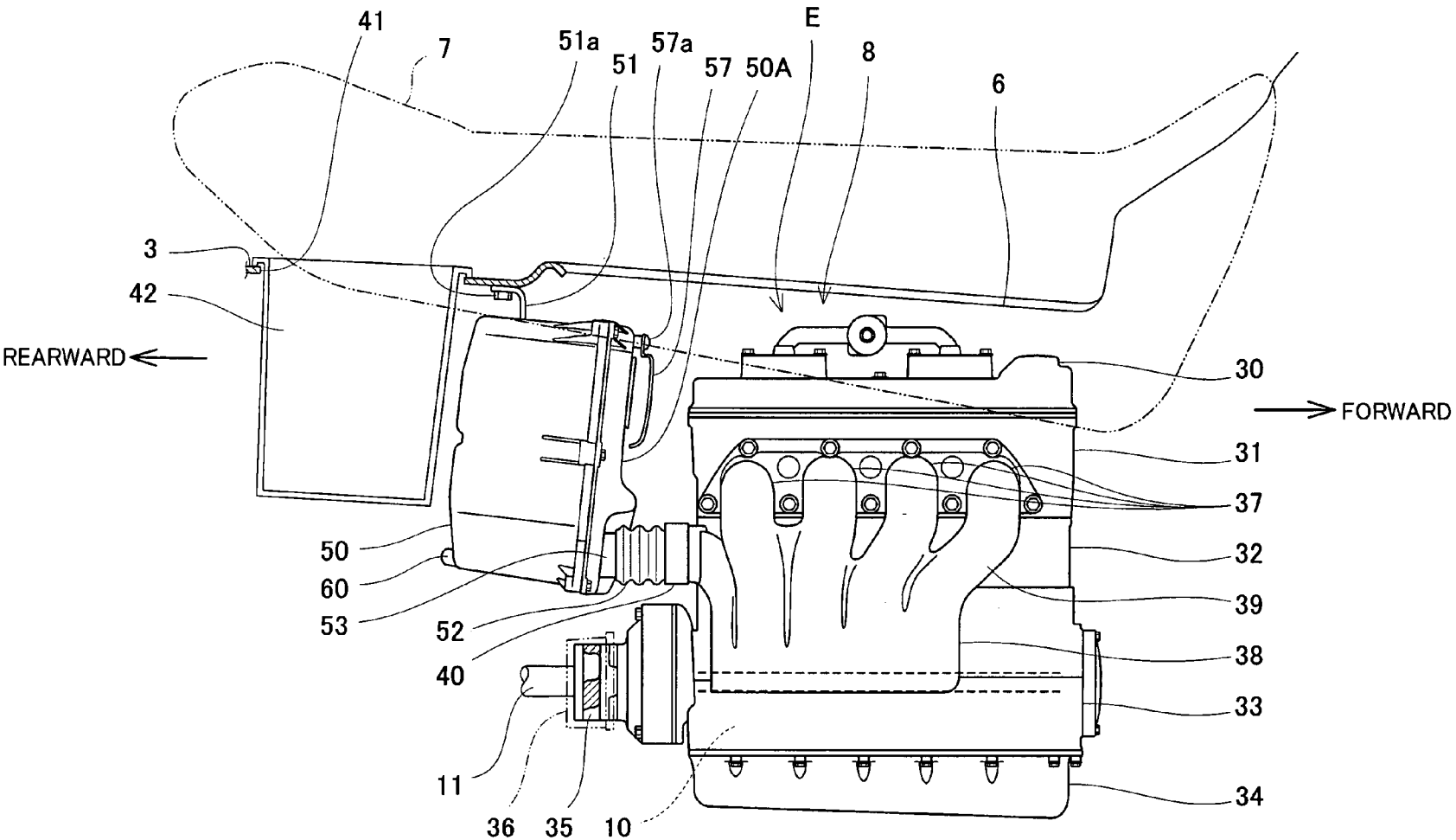
FIG. 3 is a view showing placement and a construction of an engine and auxiliary devices within an engine room of the personal watercraft in FIG. 1.

FIG. 3 shows arrangement and construction of the engine E and associated auxiliary devices mounted within the engine room 8, as seen from a right side of the watercraft. As shown in FIG. 3, the engine E is disposed below the first deck opening 6. The engine E comprises a cylinder head 31 covered with a cylinder head cover 30, a cylinder block 32 disposed below the cylinder head 31, and a crankcase 33 located below the cylinder block 32. A lower portion of the crankcase 33 is an oil pan 34.

A crankshaft 10 is mounted within the crankcase 33 and is connected to the propeller shaft 11 through a coupling mechanism 35 provided behind the engine E. And, a hood 36 is provided on an outer peripheral region of the coupling mechanism 35 to inhibit water from being scattered.

The cylinder head 31 is provided with four air-intake ports 37 on a right-side portion thereof. An air-intake chamber 38 is provided on a right side of the crankcase 33. The air-intake ports 37 are connected to the air-intake chamber 38 through an air-intake manifold 39. A throttle body 40 is provided behind the air-intake chamber 38 and configured to adjust a flow rate of air flowing into the air-intake chamber 38.

A second deck opening 41 for a storage box 42 is formed in an upper portion of the deck 3 below the seat 7 represented by two-dotted line such that the opening 41 is located spaced apart from and behind the first deck opening 6. The storage box 42 is removably fitted in the second deck opening 41 from above. The storage box 42 is tubular and has a bottom portion and an open upper portion. By removing the seat 7 and the storage box 42, inside and outside of the body 1 communicate with each other through the second deck opening 41.

An air cleaner box 50 is provided behind the engine E and in front of and in the vicinity of the storage box 42. The air cleaner box 50 is hollow and has a shape of vertically elongate rectangular parallelepiped. By removing the seat 7 and the storage box 42, the air cleaner box 50 is accessible through the second deck opening 41 for maintenance.

As shown in FIG. 3, the air cleaner box 50 is located right above the coupling mechanism 35. The air cleaner box 50 occupies a substantial part of a space above the coupling mechanism 35. The water being scattered by the coupling mechanism 35 being rotating collides against a bottom surface of the air cleaner box 50, and thus is inhibited from being scattered farther.

The air cleaner box 50 is supported by the deck 3 of the body 1. More specifically, the air cleaner box 50 has a support member 51 on an upper portion thereof. The support member 51 is fastened to an inner surface of an upper wall of the deck 3 by a fastener, such as a bolt 51*a*. The support member 51 is fastened to the deck 3 at a location in the vicinity of the storage box 42 to allow the bolt 51*a* to be accessible through the second deck opening 41, when the storage box 42 is removed. In this embodiment, the support member 51 is fastened to the upper wall of the deck 3 between the first deck opening 6 and the second deck opening 41.

An exit pipe 53 of the air cleaner box 50 is provided on a lower portion of a front wall of the air cleaner box 50. A throttle body 40 is provided between the air cleaner box 50 and the air-intake chamber 38. The exit pipe 53 is connected to the throttle body 40 through a rubber boot having a bellows-like peripheral face (flexible connecting pipe) 52, thereby allowing the air cleaner box 50 and the air-intake chamber 38 to fluidically communicate with each other.

By detaching the rubber boot 52 from the exit pipe 53, the air cleaner box 50 can be separated from the engine E. Further, by removing the bolt 51 a with which the support member 51 is fastened to the deck 3, the air cleaner box 50 can be removed from the body 1. In this embodiment, the second deck opening 41 for the storage box 42 has an opening area sufficient to allow the air cleaner box 50 to be mounted into and removed from the body 1 therethrough.

Figure 4:
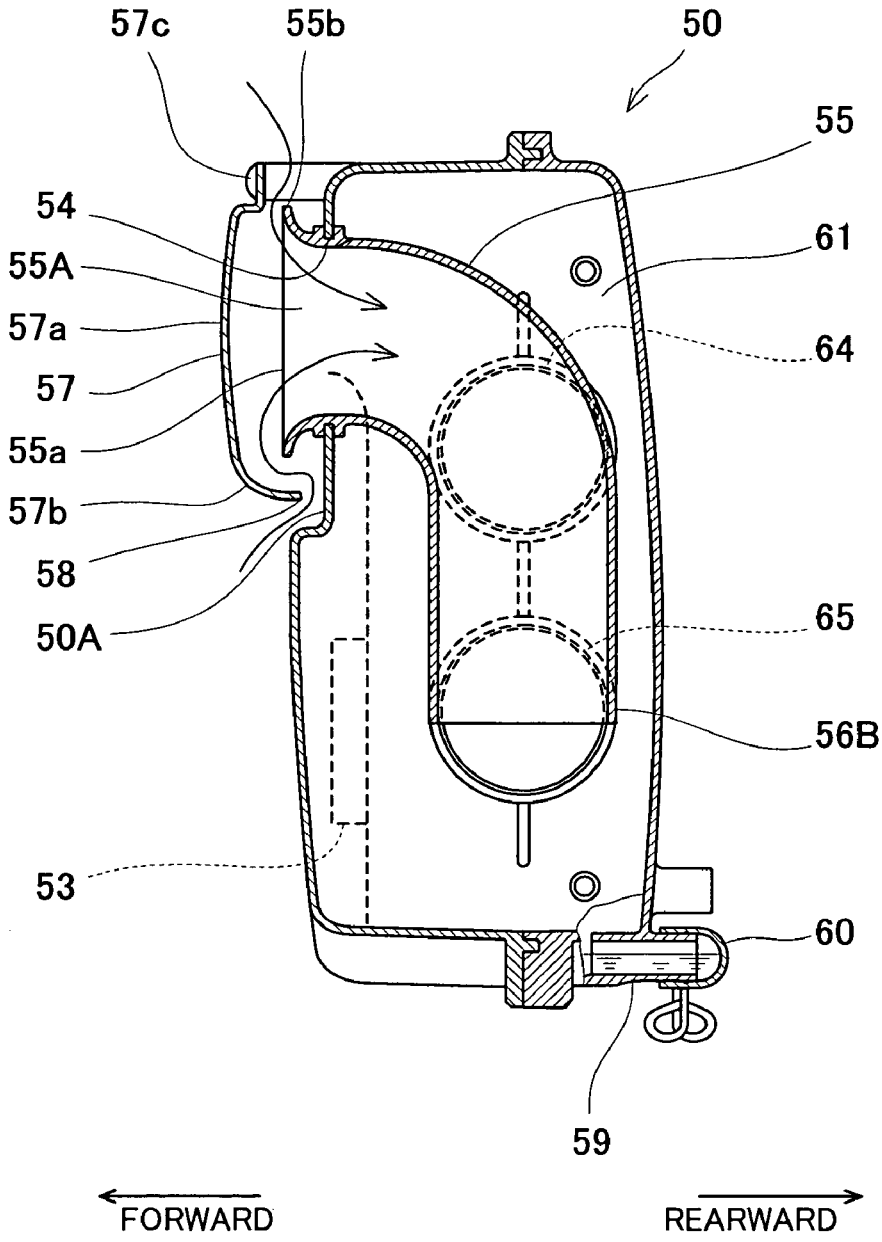
FIG. 4 is a left side cross-sectional view taken along line IV—IV in FIG. 5, showing the air cleaner box in FIG. 3.
Figure 5:
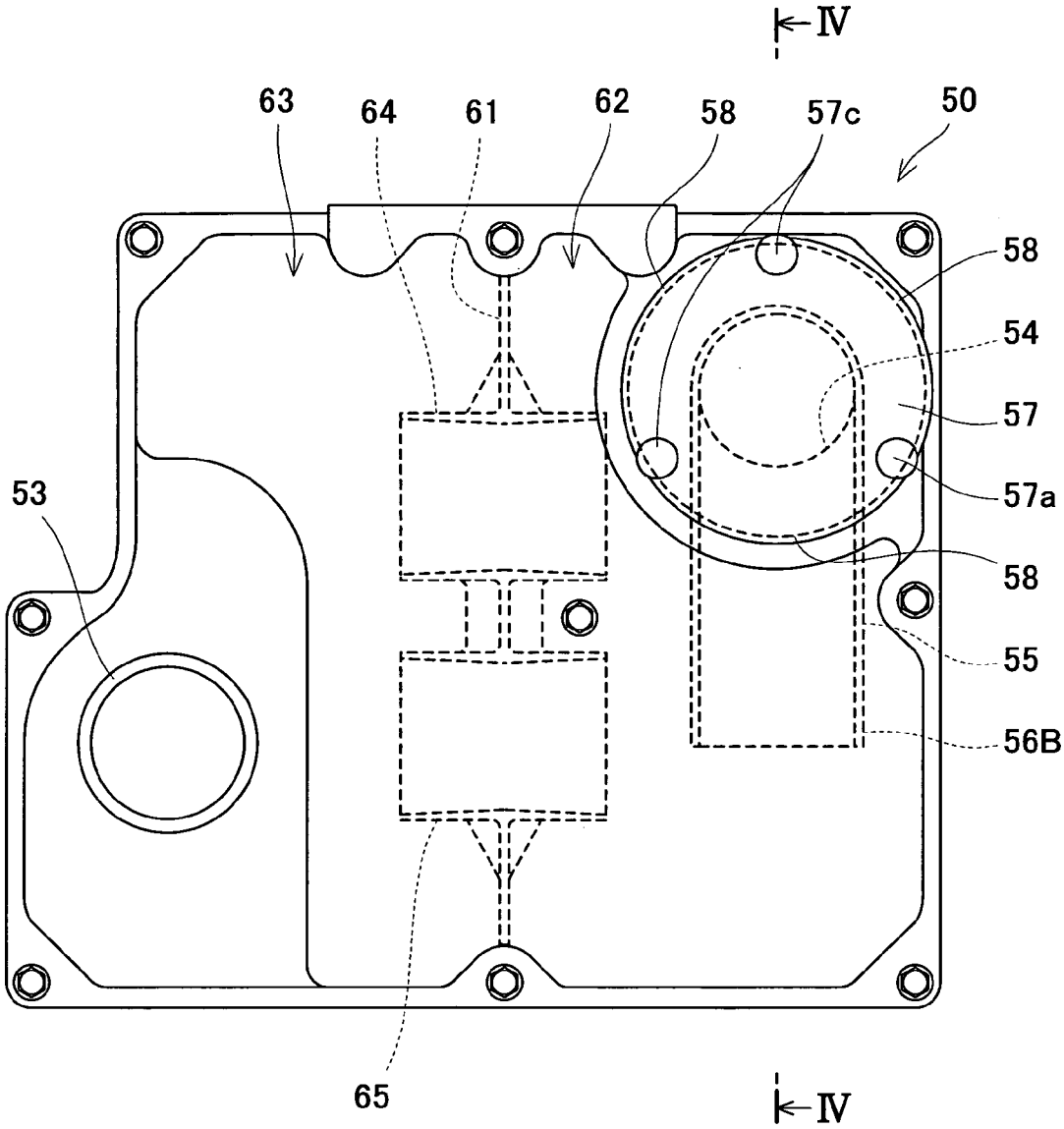
FIG. 5 is a front view of the air cleaner box in FIG. 4.

FIGS. 4 and 5 are views showing a detailed structure of the air cleaner box 50. FIG. 4 is a left side cross-sectional view taken along line IV—IV in FIG. 5, and FIG. 5 is a front view.

As shown in FIG. 4, an upper portion of the front wall of the air cleaner box 50 is slightly offset rearward relative to a lower portion thereof, thereby forming a concave portion 50A. The concave portion 50A is provided with an opening 54. An air guide pipe 55 is attached to the opening 54. The air guide pipe 55 has an air inlet 55A of the air cleaner box 50 and extends downward to an interior of the air cleaner box 50. The air inlet 55A of the air guide pipe 55 protrudes outward (forward) from the front wall having the opening 54 to which the air guide pipe 55 is attached, and has a shape that increases a diameter in the direction from inward to outward. In this structure, ambient air is smoothly guided into the air cleaner box 50.

A cover 57 is provided in front of the air inlet 55A of the air guide pipe 55 to cover the air inlet 55A. As shown in FIG. 4, the cover 57 is formed by a plate member and is disposed to have a gap so as to be spaced apart from a front end face (opening face) 55*a* of the air inlet 55A and a peripheral edge portion 55*b* of the air inlet 55A. And, the cover 57 is fastened to the front wall of the air cleaner box 50 by fasteners such as bolts 57*c* at an upper position and lower right and left positions (see FIG. 5). The cover 57 is slightly curved such that a front face portion 57*a* opposed to the opening face 55*a* of the air inlet 55A protrudes forward. And, the cover 57 is shaped such that the peripheral edge portion 57*b* is curved rearward to be close to the front wall of the air cleaner box 50, and a rear end 58 of the peripheral edge portion 57*b* is located closer to the front wall of the concave portion 50A of the air cleaner box 50 than the opening face 55*a* of the air inlet 55A. The cover 57 and the air inlet 55A form a labyrinth structure in which air snakes therein as indicated by an arrow.

As thus structured, an air flow passage extending from outside the air cleaner box 50 to the air inlet 55A is complex, which makes it difficult for water to enter the air cleaner box 50. On the other hand, since the front face portion 57*a* of the cover 57 which is opposed to the air inlet 55A of the air guide pipe 55 is curved forward, air flows smoothly into the air inlet 55A. Therefore, an increase in air-intake resistance can be inhibited.

As shown in FIG. 4, a drain pipe 59 is provided on a lower portion of a rear wall of the air cleaner box 50 so as to extend the rear wall. The drain pipe 59 allows the inside and the outside of the air cleaner box 50 to fluidically communicate with each other. An outer opening end portion of the drain pipe 59 is closed by a cap 60 made of transparent synthetic resin. The cap 60 is removably attached to the drain pipe 59 by a clamp. As shown in FIG. 3, the cap 60 is provided on a lower end of a rear portion of the air cleaner box 50 so that the cap 60 is visually checked from outside the body 1 through the second deck opening 41 for the storage box 42.

By removing the storage box 42, the water remaining within the air cleaner box 50 can be checked through the second deck opening 41. And, when the water remains within the air cleaner box 50, the clamp and the cap 60 are removed so that water is discharged through the drain pipe 59.

As shown in FIG. 5, a separating wall 61 is vertically provided within an internal space of the air cleaner box 50 to define a first space 62 and a second space 63. Two communicating pipes 64 and 65 on upper and lower sides penetrate the separating wall 61. The first and second spaces 62 and 63 fluidically communicate with each other through the communicating pipes 64 and 65.

The opening 54 to which the air guide pipe 55 is attached is formed on the front wall on the first space 62 side of the air cleaner box 50. The air guide pipe 55 extends from the opening 54 downward within the first space 62. And, a lower opening end portion (outlet) of the air guide pipe 55 opens in a lower portion of the first space 62. In this embodiment, the outlet opens in the vicinity of the communicating pipe 65 on the lower side. More specifically, it is desirable to locate the outlet higher than a water surface outside the watercraft in an inverted state. As shown in FIGS. 4 and 5, the exit pipe 53 protrudes from a lower portion of the front wall of the air cleaner box 50 and fluidically communicates with an inside of the second space 63.

The interior of the air cleaner box 50 is divided into the first and second spaces 62 and 63 by the separating wall 61, and the first and second spaces 62 and 63 fluidically communicate with each other through the communicating pipes 64 and 65. Such a structure makes it difficult for water to enter the air cleaner box 50 even when the watercraft is inverted.

While in this embodiment, the air inlet 55A is provided on the upper portion of the front wall of the air cleaner box 50, this may be provided at any other suitable locations in view of a space around the air cleaner box 50 or a distance from the coupling mechanism 35.

As this invention may be embodied in several forms without departing from the spirit of essential characteristics thereof, the above embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A water-jet propulsion personal watercraft comprising:

a body including a hull and a deck covering the deck from above;

a water jet pump disposed on a rear portion of the body and configured to propel the watercraft;

a four-cycle engine mounted forward relative to the water jet pump within the body and configured to drive the water jet pump;

a propeller shaft configured to connect the engine to the water jet pump;

a coupling mechanism disposed behind the engine and configured to connect an output shaft of the engine to the propeller shaft; and an air cleaner box disposed behind the engine and above the coupling mechanism within the body and connected to an air-intake pipe of the engine, the air cleaner box having an air inlet which opens within an engine room which is formed within the body, and the air cleaner box being configured to take in air through the air inlet for the engine from outside the watercraft, wherein the air cleaner box is removably rigidly attached by a support member to a region of the deck that is located behind and in the vicinity of a first opening which is provided at a position of the deck above the engine and is connected to the air-intake pipe of the engine through a flexible connecting pipe.

2. The water-jet propulsion personal watercraft according to claim 1, further comprising:

a storage box removably mounted behind and adjacent the air cleaner box, the storage box being mounted into the body from above.

3. The water-jet propulsion personal watercraft according to claim 2, further comprising:

a second opening provided to be spaced apart from and behind the first opening, wherein the storage box is removably fitted to the second opening, and the air cleaner box is supported by an upper wall of the deck between the first and second openings.

4. The water-jet propulsion personal watercraft according to claim 1, wherein the air inlet of the air cleaner box is provided on an upper portion of the air cleaner box and opens outward of a wall portion of the air cleaner box which forms an inner space of the air cleaner box, the air inlet being covered with a cover positioned opposite the air inlet such that the cover and the air inlet form a gap between them which forms an air passage through which air is guided from an interior of the engine room to the inner space of the air cleaner box.

5. The water jet-propulsion personal watercraft according to claim 4, wherein the air cleaner box is provided with an air guide pipe having the air inlet and an outlet and extending downward from the air inlet to a lower portion of the inner space of the air cleaner box, and the outlet opens in the lower portion of the inner space.

6. The water-jet propulsion personal watercraft according to claim 5, wherein the air inlet is provided in a concave portion configured to be caved rearward and to be formed on an upper portion of a front wall of the wall portion of the air cleaner box.

7. The water-jet propulsion personal watercraft according to claim 4, wherein the air cleaner box has a separating wall provided inside thereof and configured to divide an internal space into a plurality of sub-spaces, and a communicating passage is provided on the separating wall to allow the sub-spaces to fluidically communicate with each other.

8. A water-jet propulsion personal watercraft comprising:

a body including a hull and a deck covering the deck from above;

a water jet pump disposed on a rear portion of the body and configured to propel the watercraft;

an engine mounted forward relative to the water jet pump within the body and configured to drive the water jet pump;

a propeller shaft configured to connect the engine to the water jet pump;

a coupling mechanism disposed behind the engine and configured to connect an output shaft of the engine to the propeller shaft;

an air cleaner box disposed behind the engine and above the coupling mechanism within the body and configured to take in air for the engine from outside the watercraft;

a storage box removably mounted behind and adjacent the air cleaner box, the storage box being mounted into the body from above.

a first opening provided at a position of the deck above the engine; and a second opening provided to be spaced apart from and behind the first opening;

wherein the engine is a four-cycle engine;

wherein the storage box is removably fitted to the second opening; and wherein the air cleaner box is supported by an upper wall of the deck between the first and second openings and connected to an air-intake pipe of the engine through a flexible connecting pipe.

* * * * *